US008776896B2

(12) United States Patent
Konschuh et al.

(10) Patent No.: US 8,776,896 B2
(45) Date of Patent: Jul. 15, 2014

(54) ELECTRONIC CONTROL SYSTEM FOR A DOWNHOLE TOOL

(75) Inventors: Christopher Konschuh, Calgary (CA); Laurier E. Comeau, Calgary (CA)

(73) Assignee: Arrival Oil Tools, Inc., Calgary, Alberta (CA)

( * ) Notice: Subject to any disclaimer, the term of this patent is extended or adjusted under 35 U.S.C. 154(b) by 539 days.

(21) Appl. No.: 13/097,524

(22) Filed: Apr. 29, 2011

(65) Prior Publication Data

US 2012/0273224 A1 Nov. 1, 2012

(51) Int. Cl.
*E21B 23/00* (2006.01)
*E21B 34/06* (2006.01)

(52) U.S. Cl.
USPC ..... 166/373; 166/66.4

(58) Field of Classification Search
USPC ..... 166/373, 66.4, 316, 334.4, 386; 251/129.01, 129.02, 248
See application file for complete search history.

(56) References Cited

U.S. PATENT DOCUMENTS

| | | | | |
|---|---|---|---|---|
| 5,050,681 | A * | 9/1991 | Skinner | 166/374 |
| 6,227,302 | B1 * | 5/2001 | Pringle et al. | 166/374 |
| 6,305,467 | B1 | 10/2001 | Connell et al. | |
| 2002/0036085 | A1 | 3/2002 | Bass et al. | |
| 2005/0178560 | A1 * | 8/2005 | Johansen et al. | 166/374 |
| 2009/0235656 | A1 * | 9/2009 | Havinga | 60/445 |
| 2012/0037360 | A1 * | 2/2012 | Arizmendi et al. | 166/250.01 |
| 2012/0186878 | A1 * | 7/2012 | Eddison | 175/57 |
| 2012/0273224 | A1 * | 11/2012 | Konschuh et al. | 166/373 |
| 2013/0092372 | A1 * | 4/2013 | Clapp et al. | 166/250.17 |
| 2013/0206401 | A1 * | 8/2013 | Bhoite et al. | 166/255.1 |

FOREIGN PATENT DOCUMENTS

| | | |
|---|---|---|
| CA | 2541610 | 6/2009 |
| WO | 0233214 | 4/2002 |

OTHER PUBLICATIONS

Great Britain Combined Search and Examination Report for GB Application No. 1108948.9, dated Jul. 14, 2011, 2 pages.

* cited by examiner

*Primary Examiner* — Daniel P Stephenson
(74) *Attorney, Agent, or Firm* — Wong, Cabello, Lutsch, Rutherford & Brucculeri, LLP

(57) ABSTRACT

An electronic control system for a downhole tool controls an operational state of the downhole tool. The electronic control system receives a signal from uphole, and drives a motor to operate a valve, alternately fluidly connecting a chamber in the valve to drilling fluid in a bore of the downhole tool, causing an activation mechanism to configure the downhole tool into a first state, and fluidly connecting the chamber to an annulus surrounding the downhole tool, venting mud into the annulus.

28 Claims, 11 Drawing Sheets

SECTION A—A

SECTION B–B

SECTION C—C

ELECTRONIC CONTROL SYSTEM FOR A DOWNHOLE TOOL

TECHNICAL FIELD

The present invention relates to the field of oilfield technology, and in particular to an electronic control system for a downhole tool.

BACKGROUND ART

Downhole tools have become more complex over time, with increased need to be able to control mechanisms in those tools while they are operational downhole. Conventional downhole controllable tools have used hydraulic techniques that depend on pumps. One problem identified with current downhole technology is that every time the pump is cycled the tool automatically changes its state. This means that an operator running the tool may have to cycle the pump twice or more to get the tool into the required state which may waste rig time and annoy rig personnel.

For example, in a bypass sub embodiment, a rig operator may open the bypass sub on a trip out of the hole but want to be able to pump out of the bypass sub immediately after each connection and not have to provide additional commands to the tool. The bypass sub should just stay open until it is told to close. This has not been possible until now.

SUMMARY OF INVENTION

An electronic control system for a downhole tool controls an operational state of the downhole tool. The electronic control system receives a signal from uphole, and drives a motor to operate a valve, alternately fluidly connecting a chamber in the valve to drilling fluid in a bore of the downhole tool, causing an activation mechanism to configure the downhole tool into a first state, and fluidly connecting the chamber to an annulus surrounding the downhole tool, venting mud into the annulus. Various embodiments may employ different techniques for operating the valve, including a planetary gearhead and ball screw mechanism, for example. In one embodiment, the downhole tool is a bypass sub, wherein the electronic control system manipulates the bypass sub to open and close a bypass port.

BRIEF DESCRIPTION OF DRAWINGS

The accompanying drawings, which are incorporated in and constitute a part of this specification, illustrate an implementation of apparatus and methods consistent with the present invention and, together with the detailed description, serve to explain advantages and principles consistent with the invention. In the drawings.

DESCRIPTION OF EMBODIMENTS

In the following description, for purposes of explanation, numerous specific details are set forth in order to provide a thorough understanding of the invention. It will be apparent, however, to one skilled in the art that the invention may be practiced without these specific details. References to numbers without subscripts or suffixes are understood to reference all instance of subscripts and suffixes corresponding to the referenced number. Moreover, the language used in this disclosure has been principally selected for readability and instructional purposes, and may not have been selected to delineate or circumscribe the inventive subject matter, resort to the claims being necessary to determine such inventive subject matter. Reference in the specification to "one embodiment" or to "an embodiment" means that a particular feature, structure, or characteristic described in connection with the embodiments is included in at least one embodiment of the invention, and multiple references to "one embodiment" or "an embodiment" should not be understood as necessarily all referring to the same embodiment.

Figure 1:
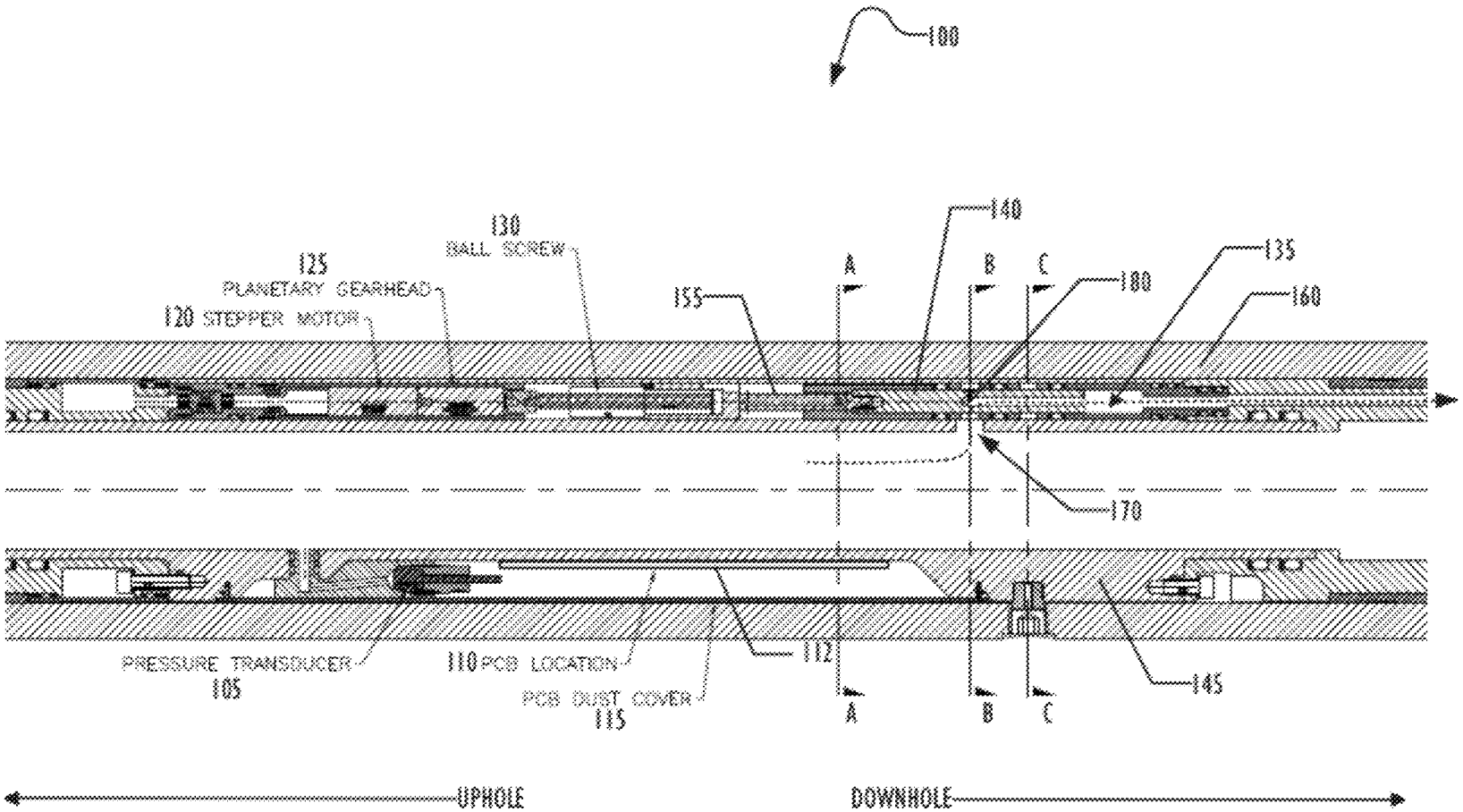
FIG. 1 is a cutaway view of an electronic control system for downhole tool according to one embodiment, in an open state.
Figure 2:
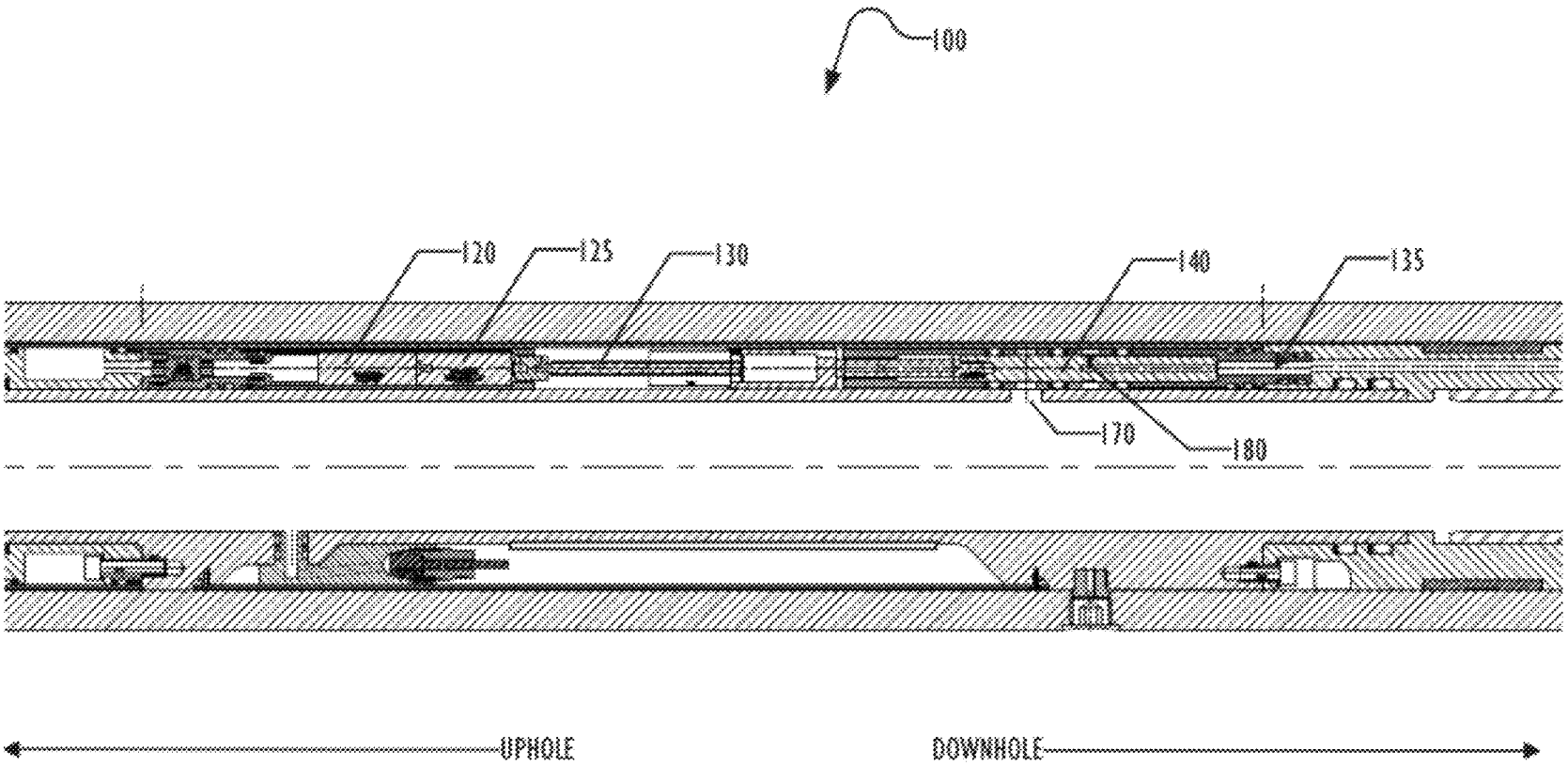
FIG. 2 is a cutaway view of the electronic control system of FIG. 1, in a closed state.

FIGS. 1 and 2 are cutaway views of an electronic control system 100 for a downhole tool according to one embodiment. In one embodiment, the downhole tool is a bypass sub, and other portions of the bypass sub according to one embodiment are illustrated in FIGS. 8-11. In FIG. 1, the electronic control system 100 is in an open state, resulting in the bypass tool being in a bypass or open state, as further illustrated in FIGS. 8 and 10. In FIG. 2, the electronic control system 100 is in a closed state, resulting in the bypass sub being in a closed state, as further illustrated in FIGS. 9 and 11.

In the embodiment of FIGS. 1 and 2, the electronic control system 100 comprises an insert 145 that is disposed inside a tubular portion 160 of the bypass sub. A stepper motor 120, disposed in a bore of the insert 145, activates a planetary gearhead 125 to engage a ball screw 130, moving a piston 140 connected to the ball screw 130. Movement of the piston 140 allows mud to flow into a chamber 135 and thence to move other sections of the bypass sub as described in the discussion of FIGS. 8-10 below.

The stepper motor 120 in one embodiment is controlled by circuitry on a printed circuit board (PCB) 112 disposed in a chamber 110 that detects signals sent as one or more pulses in the drilling fluid (also known as mud) with a pressure transducer 105, triggering the stepper motor to open or close the electronic control system 100. Any desired signaling technique known to the art may be used to signal the pressure transducer 105 for detection by the circuitry. A dust cover 115 may be used to cover the PCB chamber 110 to protect the circuitry installed therein. Although illustrated herein using a pressure transducer 105, other technologies may be used for signaling the circuitry 112 that triggers operation of the stepper motor 120. In one embodiment, the stepper motor 120 is a 48V EC motor with Hall sensors and the planetary gearhead 125 is a corresponding gearhead, both manufactured by Maxon Motor AG of Switzerland.

The use of a stepper motor, planetary gearhead, and ball screw is illustrative and by way of example only, and any other electrically driven mechanism for producing a linear movement of the piston 140 may be used. For example, in another embodiment, a solenoid may be used instead of a stepper motor. In another example, other forms of servomotors may be used instead of a stepper motor. In yet another example, other types of gearing mechanisms may be used instead of a planetary gearhead and ball screw. In yet another example, hydraulic mechanisms may be used instead of gearing to drive the piston 140.

FIG. 1 illustrates the electronic control system 100 in an open state. In this state, a port 180 in the piston 140 fluidly connected to the chamber 135 is aligned with opening 170 and allows mud to flow along the dotted line from the bore of the bypass sub through the piston 140 into the chamber 135, and thence to provide fluid pressure to open the bypass mechanism as described in more detail below. The piston 140, chamber 135, and opening 180 form a valve mechanism that can be opened or closed to allow using mud to control mechanical activation of the downhole tool.

FIG. 2 illustrates the electronic control system 100 in a closed state. In this state, the stepper motor 120 has activated the planetary gearhead 125 and ball screw 130 to move the piston 140 downhole into a closed state. In this state, the port 180 provides fluid communication to an annulus vent port 315 (described below) to allow venting the pressurized mud into the annulus and closing the bypass mechanism.

Although as illustrated in FIGS. 1 and 2 the piston 140 is urged downhole to close the electronic control system 100 and uphole to open it, the opening 170 and port 180 may be positioned to open the electronic control system 100 by movement downhole and to close the electronic control system 100 by movement uphole.

Figure 3:
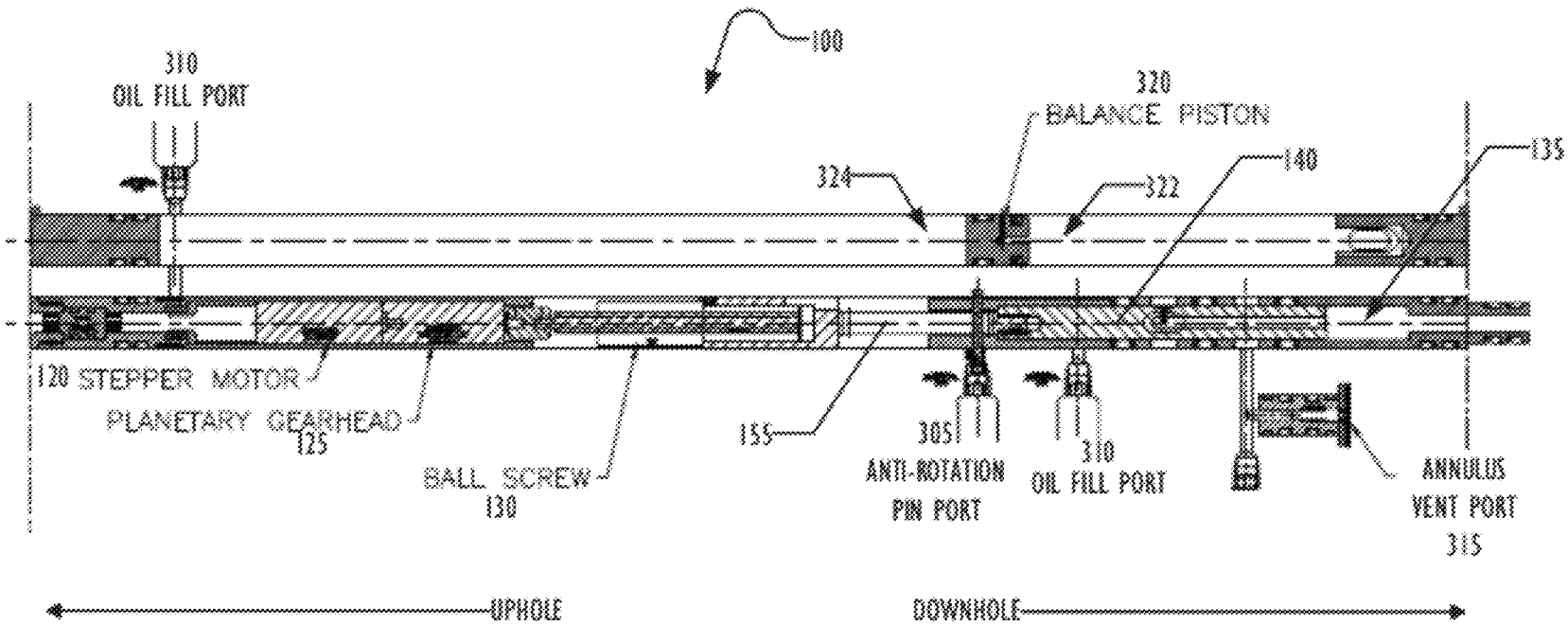
FIG. 3 is a cutaway view of a portion of the electronic control system of FIG. 1, in a closed state.

FIG. 3 is a cutaway view illustrating the construction of the electronic control system 100 according to one embodiment. The stepper motor 120, planetary gearhead 125, ball screw 130, and connecting rod 155 are positioned in a bore of the insert 145. An oil port 310 may be drilled or otherwise formed to allow the stepper motor 120, planetary gearhead 125, ball screw 130, and connecting rod 155 to be bathed in oil for cooling and lubrication purposes. Other oil fill ports 310 may be provided as desired. An anti-rotation pin port 305 may be drilled or otherwise formed through the bore to allow insertion of an anti-rotation pin to prevent rotation of the female end of the ball screw mechanism 130.

An annulus vent port 315 may be drilled or otherwise formed in the insert 145 and surrounding tubular portion 160 to allow venting of mud from the chamber 135 into the annulus when the electronic control system 100 is in the closed state, as illustrated in FIG. 2.

Figure 4:
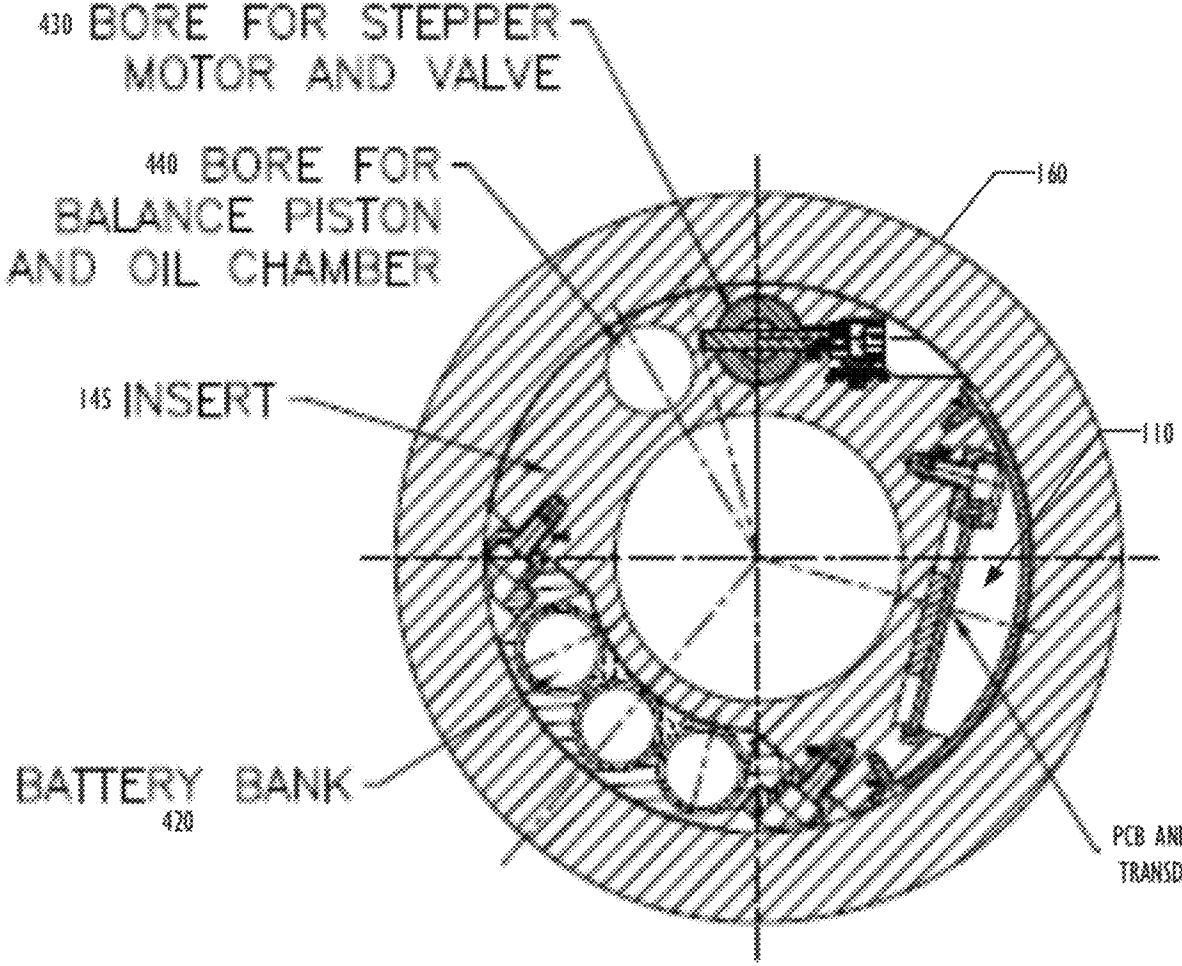
FIG. 4 is a cross-sectional view of the electronic control system of FIG. 1 along line A-A.

FIG. 4 is a cross-sectional view of the bypass sub illustrated in FIG. 1 along line A-A. A PCB and pressure transducer slot 410 formed in the insert 145 forms the chamber 110 with the tubular portion 160 of the bypass sub. The slot 410 may be milled or otherwise formed into the insert 145. Two bores 430 and 440 are illustrated in FIG. 4. Bore 430 is used for placement of the stepper motor 120 and valve mechanisms described above. A second bore 440 provides for placement of a balance piston 320 for equalization of pressure on the oil side 324 and mud side 322 of the balance piston 320. Oil on the oil side 324, which is in fluid communication with the bore 440, may thus be pressurized to prevent intrusion of mud into the space around the motor 120, gearhead 125, and ball screw 130. Also illustrated in FIG. 4 is a battery bank 420 used for powering the circuitry 112 in the PCB chamber 110 and the stepper motor 120. As illustrated, the battery bank is disposed in an arc on one side of the insert 145. The batteries used in the battery bank 420 are preferably lithium-ion batteries, but other kinds of batteries may be used as desired. The number of batteries contained in the battery bank 420 may depend upon operational considerations such as the length of time that the downhole tool needs to be operational downhole. The arrangement and positioning of bores 430 and 440 and slot 410 is illustrative and by way of example only, and other arrangements and positions may be used. In another embodiment, power for the circuitry 112 and stepper motor 120 may be provided by a downhole generator disposed with the downhole tool. Alternately, in some embodiments, power to the electrical devices of the electronic control system 100 may be provided via a cable from the surface; in such an embodiment, instead of using pressure pulses in the mud, the cable (not shown) may transmit power and electrical signals to the circuitry 112 without the need for a pressure transducer 105.

Figure 5:
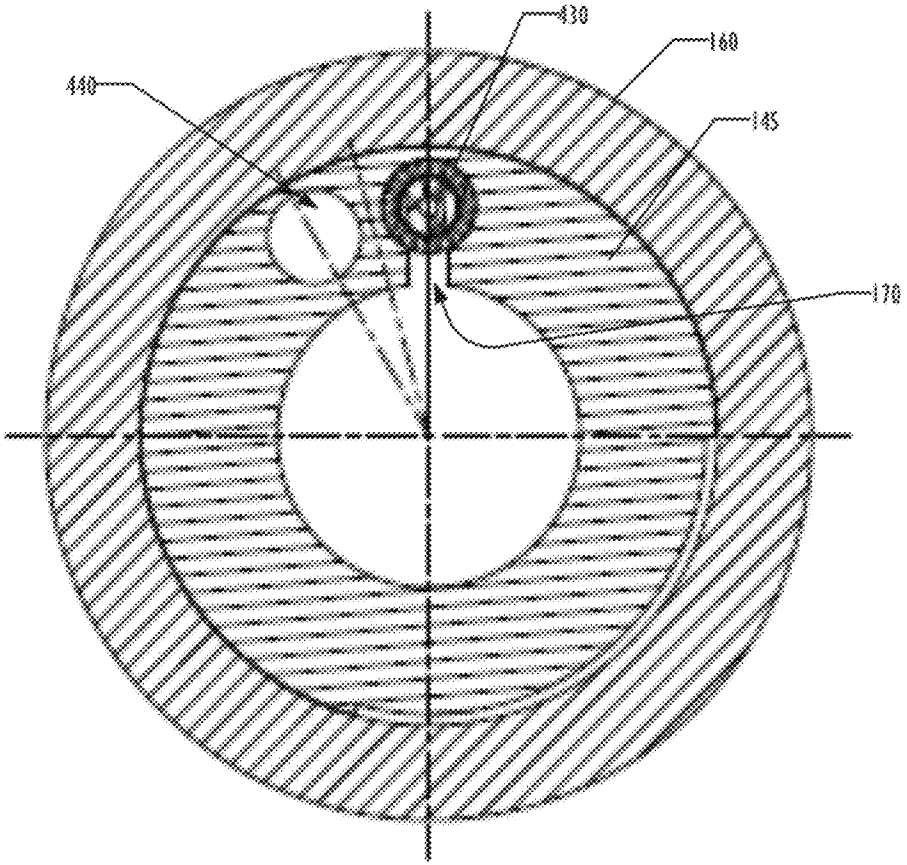
FIG. 5 is a cross-sectional view of the electronic control system of FIG. 1 along line B-B.

FIG. 5 is a cross-sectional view along line B-B of FIG. 1, further illustrating the opening 170 formed in the insert 145 for fluid communication with the chamber 135 inside bore 430 when the piston 140 is in the open position.

Figure 6:
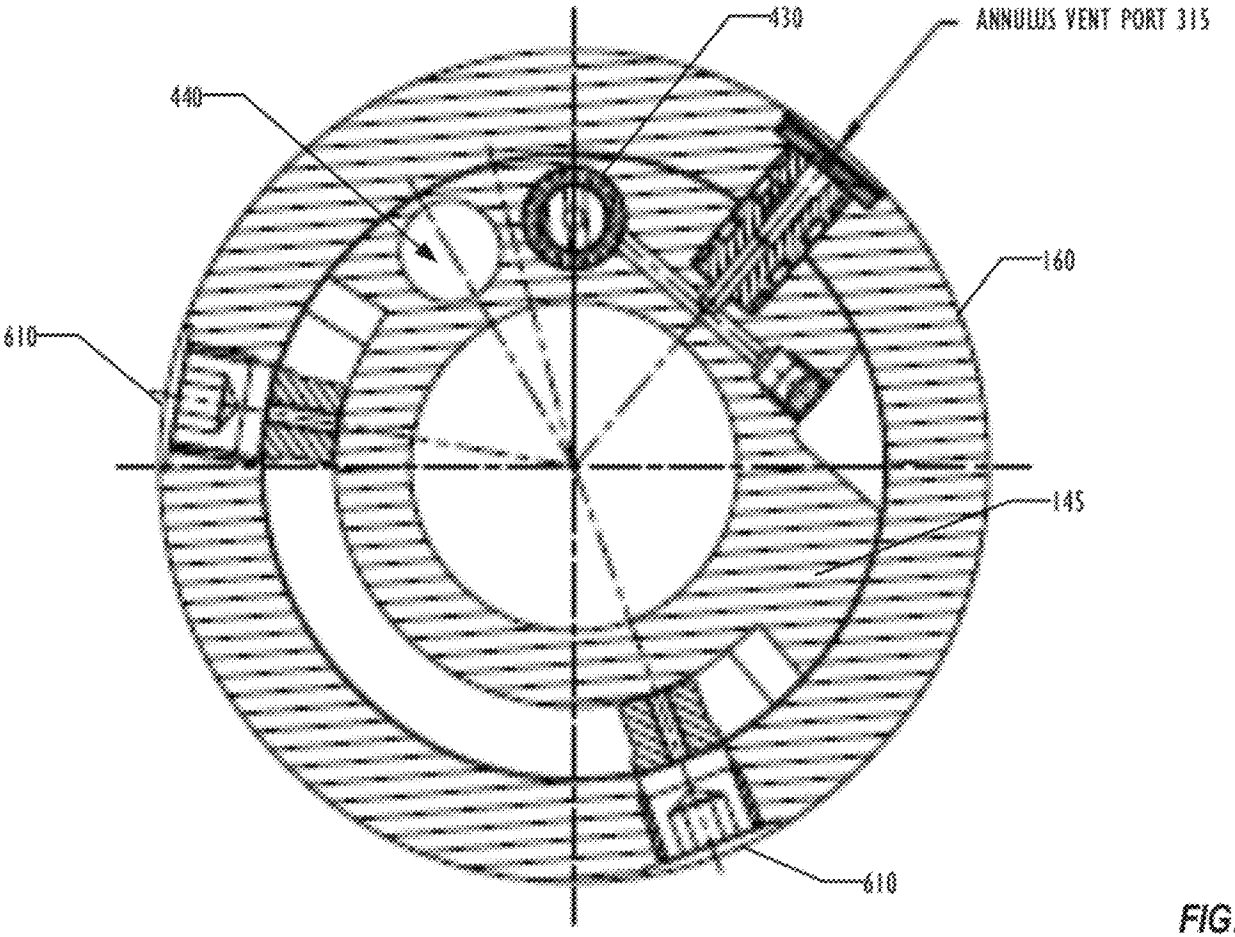
FIG. 6 is a cross-sectional view of the electronic control system of FIG. 1 along line C-C.

FIG. 6 is a cross-sectional view along line C-C of FIG. 1, further illustrating the insert 145 and the annulus vent port 315 that allows venting of pressurized mud to the annulus when the electronic control system 100 is in the closed state. As illustrated in FIG. 6, screws or other desired attachment mechanisms 610 may be used to fix the insert 145 relative to the tubular portion 160 of the downhole tool.

Figure 7:
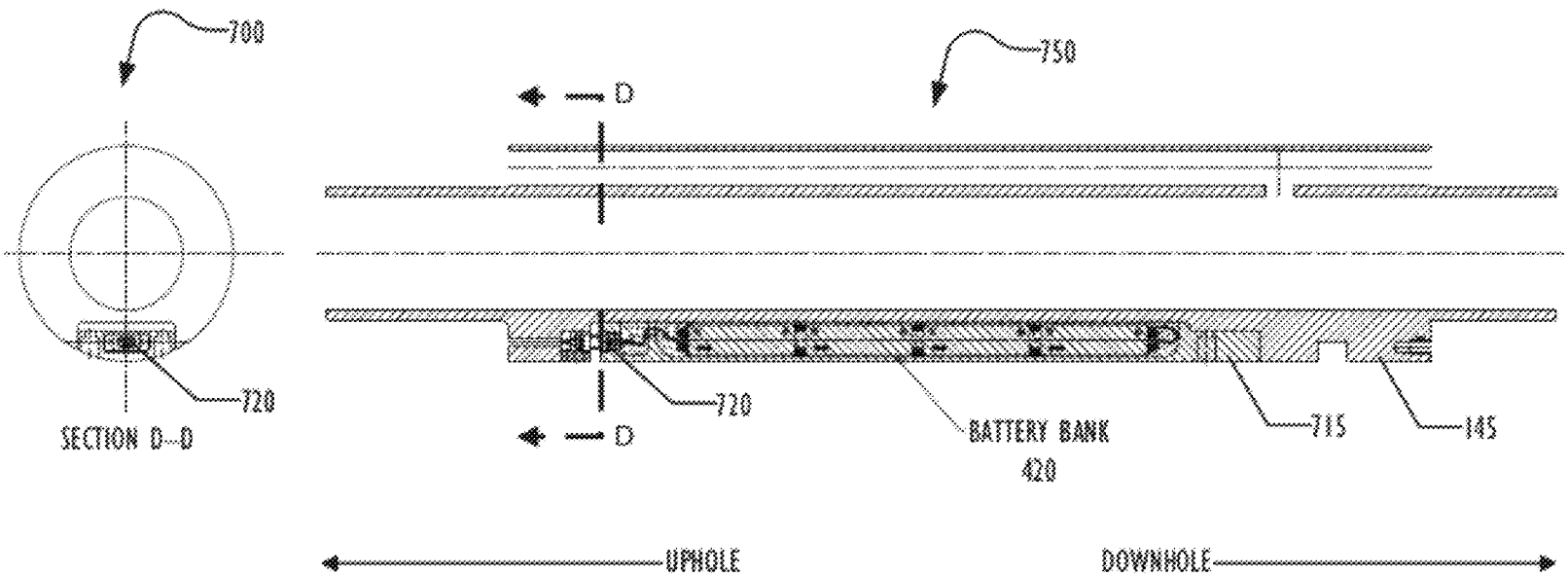
FIG. 7 is a cutaway view of a portion of an electronic control system according to one embodiment.

FIG. 7 is two cutaway views of the insert 145 illustrating placement of the battery bank 420. The battery bank 420 may be attached to the insert 145 as a battery module 715 as illustrated in view 750 of FIG. 7. View 700 is a cross-section along line D-D of view 750 illustrating the connector 720 that may be used for connecting the battery bank 420 to the other electrical components of the electronic control system 100. As illustrated, the connector 720 is an MDM-type connector, but other connector types may be used as desired.

Figure 8:
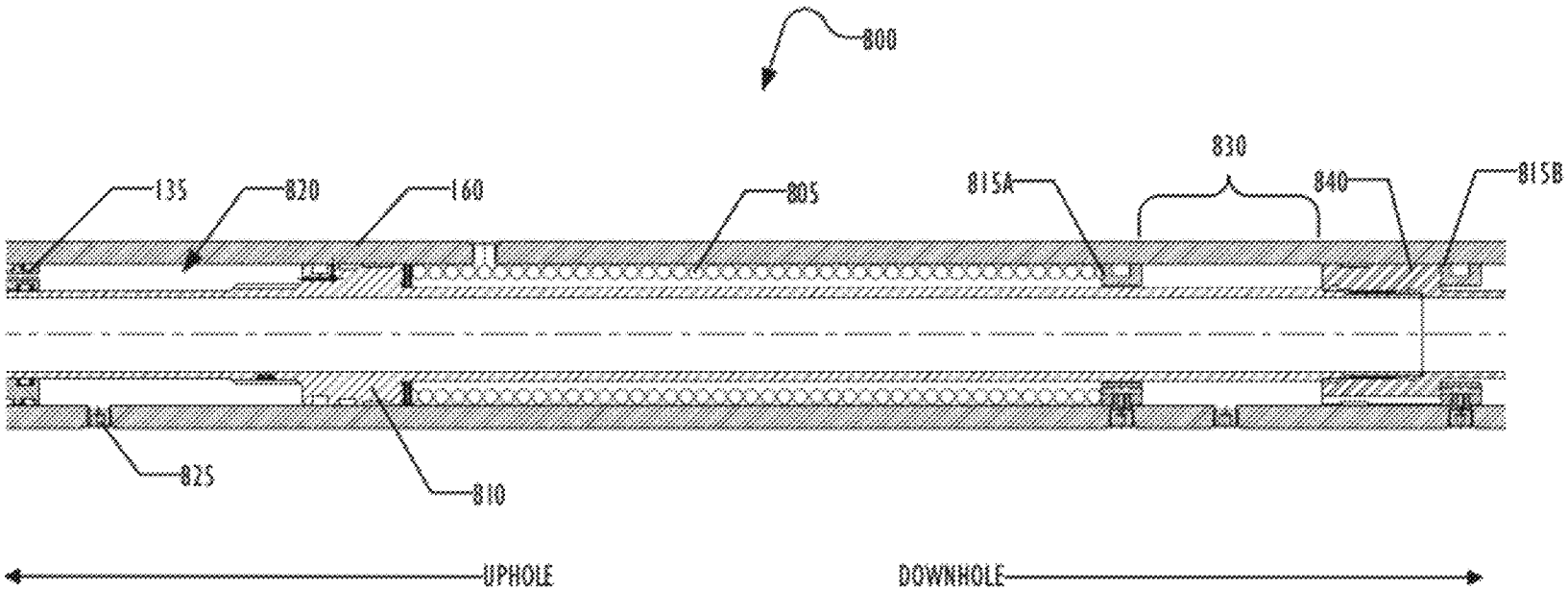
FIG. 8 is a cutaway view of a portion of an activation mechanism for use by the electronic control system of FIG. 1, in an open state.
Figure 9:
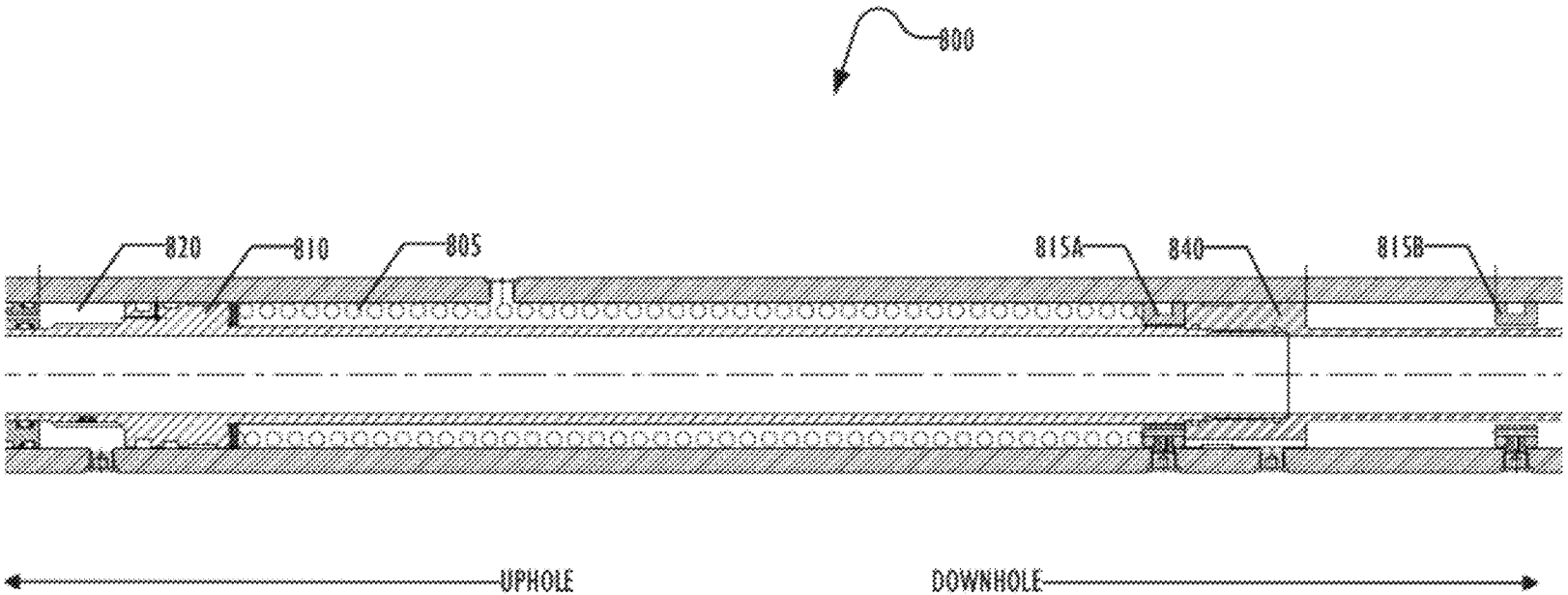
FIG. 9 is a cutaway view of a portion of an activation mechanism for use by the electronic control system of FIG. 1, in a closed state.

FIG. 8 is a cutaway view illustrating a portion 800 of an activation mechanism controlled by the electronic control system 100. A first mandrel 810 is disposed with the electronic control system 100 within the tubular portion 160 of the downhole tool, biased by a spring 805 in the uphole direction. A chamber 820 formed between the first mandrel 810 and the tubular portion 160 of the downhole tool is in fluid communication with the chamber 135 of the electronic control system 100. When pressurized by opening the valve mechanism of the electronic control system 100, pressure on the first mandrel 810 urges it in the downhole direction against the biasing pressure exerted by spring 805. Spring 805 is positioned against a block 815A that is attached to the tubular portion 160. A second mandrel 840 is connected to the first mandrel 810 so that the second mandrel is urged downhole responsive to movement downhole of the first mandrel. A mounting block 815B stops movement of the second mandrel 840 downhole, allowing a predetermined stroke 830 of the second mandrel 840. FIG. 9 is a cutaway view of the activation mechanism 800 when the electronic control system is in a closed state, showing that uphole movement of the second mandrel 840 (and thus the uphole movement of the first mandrel 810) produced by spring 805 is limited by the first block 815A.

Figure 10:
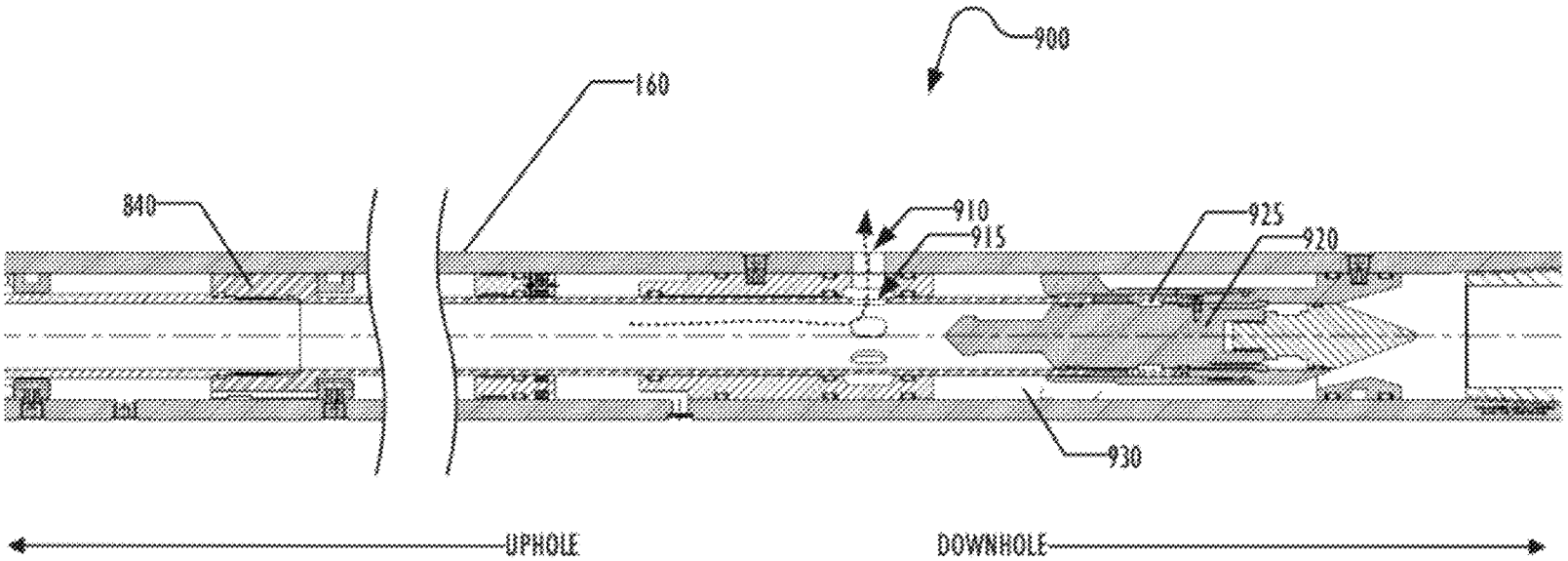
FIG. 10 is a cutaway view of a second portion of an activation mechanism for use by the electronic control system of FIG. 1, in an open state.
Figure 11:
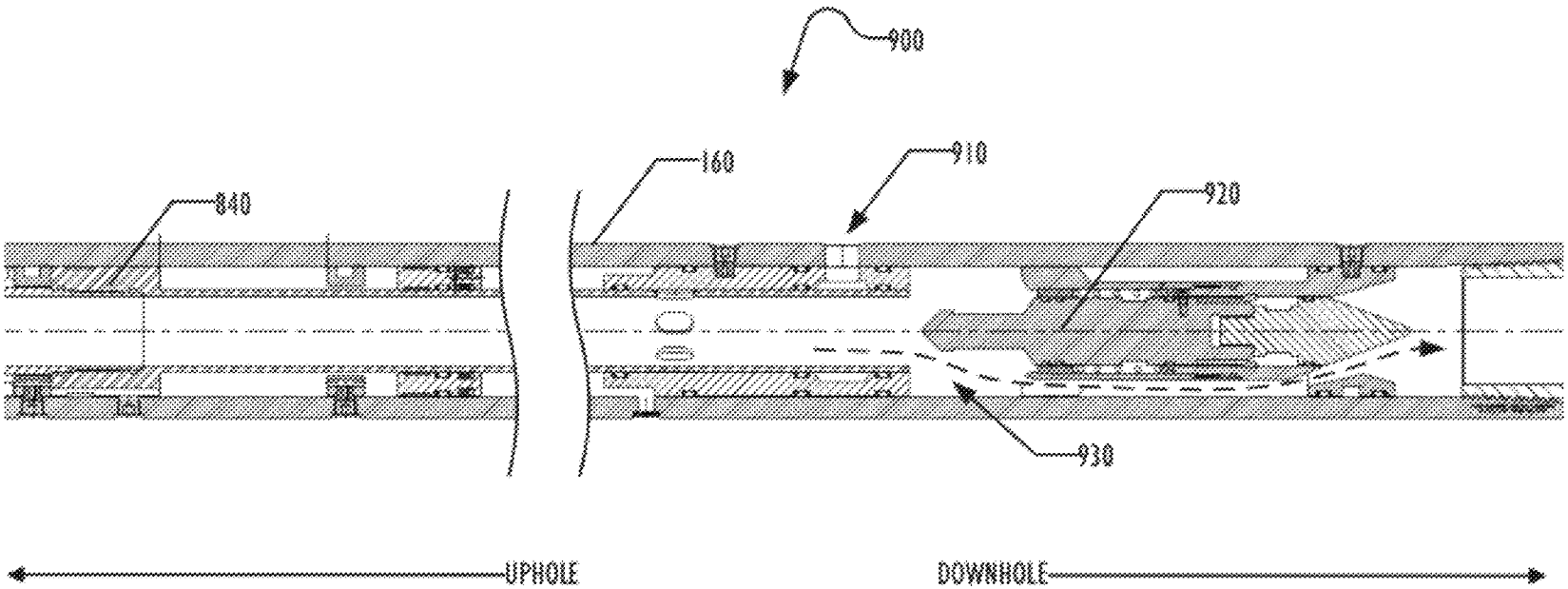
FIG. 11 is a cutaway view of a second portion of an activation mechanism for use by the electronic control system of FIG. 1, in a closed state.

FIG. 10 is a cutaway view further illustrating a second portion 900 of an activation mechanism controlled by the electronic control system 100. The second mandrel 840, in FIG. 10 illustrated in an open state, having been urged downhole by the first mandrel 810, aligns an opening 915 in the mandrel 840 with an opening 910 in the tubular portion 160 of the downhole tool, allowing mud to flow through the tubular portion 160 into the annulus surrounding the bypass sub, as illustrated by the dotted line. Any number of openings 915 and 910 may be used as desired, and preferably are spaced around the circumference of the second mandrel 840 and the tubular portion 160 of the bypass sub. An end portion of the second mandrel 840 engages a spring 925 of a throat unit 920, closing off passageway 930 and preventing mud from flowing down the tubular to other attached portions of the drill string of which the backup sub is a part. When the electronic control system 100 is closed, spring 925 urges the second mandrel 840 away from the throat unit 920 into the position shown in FIG. 11. In this position, mud may flow through the passageway 930 around the throat unit 920 downhole, as illustrated by the dashed line.

In operation, a predetermined pulse or sequence of pulses may be transmitted downhole through the mud and converted by the pressure transducer 105 into electrical signals. The circuitry 112 may then determine that the electrical signals match a predetermined trigger signal to cause the activation or deactivation of the electronic control system 100. In one embodiment, a first trigger signal may be used as an activation signal and a second trigger signal may be used as a deactivation signal. In other embodiments, a single signal may be used as both activation signal and a deactivation signal. The circuitry 112, upon detection of an activation or deactivation signal, drives the stepper motor 120 to open or close the valve mechanism of the electronic control system 100 by moving the piston 140. Upon opening the electronic control system 100 and aligning the port 180 with the opening 170, mud can traverse the chamber 135 to activate the mechanical mechanism described above that aligns opening 910 and opening 915, allowing mud to flow through the tubular portion of the backup sub into the annulus surrounding the backups. Similarly, upon closing the electronic control system 100 so that the port 180 is no longer aligned with opening 170, the mechanical mechanism described above vents mud through the annulus vent port 315, closing the bypass port formed by opening 910 and opening 915, with the result that mudflows downhole through the drill string.

Although described herein in terms of a bypass sub, the electronic control system 100 may be employed in other types of downhole tools, to activate those tools while in use downhole. These tools may include adjustable gauge stabilizers, reamers, and any other type of downhole tool that might benefit from and electro-mechanical control mechanism that operates downhole.

Although the example embodiments described above illustrate an activation technique using an uphole-downhole linear displacement of an activation mechanism driven by the electronic control system 100, other embodiments may convert the linear movement of the piston 140 into a rotational movement, allowing the electronic control system to rotate a driven portion of the downhole tool as desired. Furthermore, although described above in terms of a linear movement of a piston 140, other embodiments of the electronic control system 100 generate rotational movements of elements to open or close a valve mechanism. In yet other embodiments, rotational activation of the downhole tool may be performed directly by the stepper motor 120, or the stepper motor 120, planetary gearhead 125, and ball screw 130, without depending upon a valve mechanism using mud to effect movement of activation mechanism.

It is to be understood that the above description is intended to be illustrative, and not restrictive. For example, the above-described embodiments may be used in combination with each other. Many other embodiments will be apparent to those of skill in the art upon reviewing the above description. The scope of the invention therefore should be determined with reference to the appended claims, along with the full scope of equivalents to which such claims are entitled. In the appended claims, the terms "including" and "in which" are used as the plain-English equivalents of the respective terms "comprising" and "wherein."

What is claimed is:

1. A control system for a downhole tool, comprising:
a motor;
a control circuitry, configured to receive a signal and to control the motor responsive to the signal;
a pressure transducer, coupled to the control circuitry, such that a pressure pulse in a drilling fluid is received as an electrical signal by the control circuitry;
a valve, driven by the motor; and
an activation mechanism, coupled to the valve and adapted to change the configuration of the downhole tool under control by the circuitry,
wherein the motor, the control circuitry, the valve, and the activation mechanism are disposed within a bore of the downhole tool.

2. The control system of claim 1,
wherein the motor is a stepper motor,
further comprising:
a planetary gearhead, driven by the motor; and
a ball screw, driven by the planetary gearhead and coupled to the valve.

3. The control system of claim 1, wherein the valve comprises:
a piston, mechanically coupled to the motor, forming a chamber fluidly coupled to the activation mechanism,
wherein the piston in a first position fluidly connects the chamber to a drilling fluid within a bore of the downhole tool.

4. The control system of claim 3, wherein the piston in a second position fluidly connects the chamber to an annulus surrounding the downhole tool.

5. The control system of claim 1, further comprising:
an insert, disposed within a bore of the downhole tool,
wherein the motor and the valve are disposed in a bore formed in the insert.

6. The control system of claim 5, wherein the control circuitry is disposed within a chamber formed by the insert and a tubular portion of the downhole tool.

7. The control system of claim 1, further comprising:
a battery, electrically connected to the control circuitry and the motor.

8. The control system of claim 1, wherein the activation mechanism comprises:
a first mandrel, disposed within the bore of the downhole tool and fluidly connected to the valve,
wherein the first mandrel is urged downhole when the valve is in a first state and moves uphole when the valve is in a second state.

9. The control system of claim 8, wherein the activation mechanism further comprises:
a second mandrel, coupled to the first mandrel and adapted to change a configuration of the downhole tool to a first state when the first mandrel is urged downhole and to change a configuration of the downhole tool to a second state when the first mandrel moves uphole.

10. A downhole tool, comprising:
a first mechanism having a first state and a second state; and a control system, coupled to the first mechanism, comprising:

a motor;

a control circuitry, configured to receive a signal and to control the motor responsive to the signal;

a pressure transducer, coupled to the control circuitry, such that a pressure pulse in a drilling fluid is received as an electrical signal by the control circuitry;

a valve, driven by the motor; and an activation mechanism, coupled to the valve and adapted to change the first mechanism between the first state and the second state under control by the circuitry, wherein the motor, the control circuitry, the valve, and the activation mechanism are disposed within a bore of the downhole tool.

11. The downhole tool of claim 10, wherein the downhole tool is a bypass sub, wherein the first mechanism is a bypass port, and wherein the bypass port is open in the first state of the first mechanism and closed in the second state of the first mechanism.

12. The downhole tool of claim 10, further comprising:

a second mechanism, coupled to the control system, wherein the activation mechanism is further adapted to change the second mechanism between a first state and a second state under control by the control circuitry.

13. The downhole tool of claim 12, wherein the downhole tool is a bypass sub, wherein the second mechanism is a throat unit of the bypass sub, wherein a passageway through the throat unit is open in the second state of the second mechanism and closed in a first state of the second mechanism.

14. The downhole tool of claim 10, wherein the control system further comprises:

a planetary gearhead, driven by the motor; and a ball screw, driven by the planetary gearhead and coupled to the valve.

15. The downhole tool of claim 10, wherein the valve comprises:

a piston, mechanically coupled to the motor, forming a chamber fluidly coupled to the activation mechanism, wherein the piston in a first position fluidly connects the chamber to a drilling fluid within a bore of the downhole tool.

16. The downhole tool of claim 15, wherein the piston in a second position fluidly connects the chamber to an annulus surrounding the downhole tool.

17. The downhole tool of claim 10, wherein the control system further comprises:

an insert, disposed within a bore of the downhole tool, wherein the motor and the valve are disposed in a bore formed in the insert.

18. The downhole tool of claim 17, wherein the control circuitry is disposed within a chamber formed by the insert and a tubular portion of the downhole tool.

19. The downhole tool of claim 10, wherein the control system further comprises:

a battery, electrically connected to the control circuitry and the motor.

20. The downhole tool of claim 10, wherein the activation mechanism comprises:

a first mandrel, disposed within the bore of the downhole tool and fluidly connected to the valve, wherein the first mandrel is urged downhole when the valve is in a first state and moves uphole when the valve is in a second state.

21. The downhole tool of claim 20, wherein the activation mechanism further comprises:

a second mandrel, coupled to the first mandrel and adapted to change a configuration of the downhole tool to a first state when the first mandrel is urged downhole and to change a configuration of the downhole tool to a second state when the first mandrel moves uphole.

22. A method of operating a downhole tool, comprising:

disposing a control system within a bore of the downhole tool;

receiving a signal by a control circuitry of the control system, comprising:

receiving an electrical signal by the control circuitry transduced from a pressure pulse in a drilling fluid by a pressure transducer;

controlling a motor of the control system by the control circuitry responsive to the signal;

driving a valve of the control system by the motor responsive to the control circuitry; and changing an operational mechanism of the downhole tool between a first state and a second state depending on a state of the valve.

23. The method of claim 22, wherein the act of driving a valve of the control system by the motor responsive to the control circuitry comprises:

opening the valve, fluidly connecting the bore of the downhole tool with a chamber of a piston of the control system.

24. The method of claim 23, wherein the act of driving a valve of the control system by the motor responsive to the control circuitry further comprises:

closing the valve, fluidly connecting the chamber with an annulus surrounding the downhole tool.

25. The method of claim 22, wherein the act of changing a mechanism of the downhole tool between a first state and a second state depending on a state of the valve comprises:

pressurizing a chamber of an activation mechanism with a drilling fluid, causing downhole movement of the activation mechanism to change the operational mechanism of the downhole tool.

26. The method of claim 25, wherein the act of changing a mechanism of the downhole tool between a first state and a second state depending on a state of the valve further comprises:

venting the chamber of the activation mechanism to an annulus surrounding the downhole tool.

27. The method of claim 22, wherein the act of changing a operational mechanism of the downhole tool between a first state and a second state depending on a state of the valve comprises:

opening and a bypass port of a bypass sub and closing a downhole passageway about a throat unit of the bypass sub to change the downhole tool into the first state; and closing the bypass port and opening the downhole passageway about the throat unit to change the downhole tool into the second state.

28. The method of claim 22, further comprising:

powering the control system with a battery disposed within a bore of the downhole tool.

* * * * *